US006179503B1

(12) United States Patent
Taghavi-Khanghah

(10) Patent No.: US 6,179,503 B1
(45) Date of Patent: Jan. 30, 2001

(54) BRUSH

(75) Inventor: Said Taghavi-Khanghah, Newcastle Upon Tyne (GB)

(73) Assignee: Veresk Biosystems Limited (GB)

( * ) Notice: Under 35 U.S.C. 154(b), the term of this patent shall be extended for 0 days.

(21) Appl. No.: 09/485,748

(22) PCT Filed: Aug. 3, 1998

(86) PCT No.: PCT/GB98/02319

§ 371 Date: Feb. 15, 2000

§ 102(e) Date: Feb. 15, 2000

(87) PCT Pub. No.: WO99/08564

PCT Pub. Date: Feb. 25, 1999

(30) Foreign Application Priority Data

Aug. 19, 1997 (GB) ..... 9717429

(51) Int. Cl.[7] ..... B43M 11/02

(52) U.S. Cl. ..... 401/184; 401/187; 401/145; 401/153; 401/270; 401/282

(58) Field of Search ..... 401/184, 183, 401/145, 152, 153, 156, 186, 270, 271, 282, 289

(56) References Cited

U.S. PATENT DOCUMENTS

| | | | | |
|---|---|---|---|---|
| 2,018,158 | * | 10/1935 | Violette | 401/271 |
| 2,743,042 | * | 4/1956 | Burgin | 401/271 |
| 5,746,532 | * | 5/1998 | Megill et al. | 401/271 |
| 5,846,010 | * | 12/1998 | Barbalich | 401/183 |

* cited by examiner

*Primary Examiner*—David J. Walczak
(74) *Attorney, Agent, or Firm*—Larson & Taylor, PLC

(57) ABSTRACT

A toothbrush with a toothpaste reservoir and a simple control delivering mechanism which is associated with an elastomeric valve system for dispensing an amount of oral hygienic paste onto bristles on the toothbrush.

12 Claims, 3 Drawing Sheets

BRUSH

TECHNICAL FIELD

This invention relates to brushes, and has particular, though not exclusive, application to toothbrushes.

BACKGROUND ART

Current toothbrushes are commonly one of two different types. The first type requires the user to dispense a quantity of toothpaste from a tube or container onto the bristles of the toothbrush. Such an arrangement requires the provision of separate containers and toothbrushes, and the step of charging the toothbrush with toothpaste from the container prior to use, which can be a messy and time-consuming operation.

The second type of toothbrush incorporates its own container of toothpaste, usually in or as the handle of the toothbrush. The container, once empty, can either be refilled or replaced. However, such arrangements suffer from a number of disadvantages, not the least of which is that the overall toothbrush is of relatively complex construction and is therefore expensive to manufacture, operation of the toothbrush usually requiring the actuation and/or manipulation of several different elements within the system.

For example it is known to provide a toothbrush provided with a head having one or more openings therein feeding to the bristles, and a flow control mechanism for the toothpaste including a slide member movable longitudinally within the brush relative to the head to open and close the or each opening whereby paste from a container connected to the head can be pumped from the container through the or each opening, when open, onto the bristles.

However, the provision of the slide member within the neck and head of the toothbrush imposes severe restrictions on the configuration of the toothbrush, and in particular prevents the provision of an angled, flexible neck as is currently considered desirable for optimum handling purposes. Furthermore, the presence of the slide member necessitates the neck and head of the toothbrush being of a thickness greater than would otherwise be desirable.

Furthermore, the openings in the head through which the paste flows to the bristles tend to retain paste therein even after use, and/or are such as to cause water ingress to the head of the toothbrush. Such water ingress can result in bacterial growth within the toothbrush resulting in an unhygienic product.

SUMMARY OF THE INVENTION

It would be desirable to be able to provide a toothbrush which overcomes the aforementioned disadvantages, and in particular which enables flexibility in design, is simple to operate and is hygienic in use.

According to the present invention there is provided a brush comprising a head including a plurality of bristles thereon, at least one outlet in the head feeding to said bristles, a container of paste connected to said head, and actuating means for feeding paste from the container longitudinally of the brush to the head, characterised by, for the or each outlet, a control valve of a flexible plastics material including a diaphragm portion and a nose portion extending from one side of the diaphragm portion, the control valve being positioned within the head with the central axis thereof substantially perpendicular to the direction of flow of paste to the head and having a normal rest position in which the nose portion engages in, to seal, the outlet in the head, the other side of the diaphragm portion of the control valve remote from the nose portion being open to the atmosphere, the arrangement being such that, on operation of the actuating means, paste is fed under pressure from the container to the head to engage with the one side of the diaphragm portion to distort said diaphragm portion whereby the nose portion of the valve is displaced from the outlet and paste is dispensed therethrough, and, on subsequent depressurisation of the paste, the control valve returns, under the influence of its inherent flexibility and atmospheric pressure, to its rest position with the nose portion seating in, to seal, the outlet.

It will be appreciated that, with such an arrangement, it is the pressure of the paste itself which serves to open the or each outlet in the head by deforming the or each valve, there being no requirement for any mechanical linkage between the actuating means and the head of the brush. Thus the hollow neck of the brush which conventionally interconnects the container with the head can take a variety of configurations, and may be angled relative to the length of the brush, and flexible relative to the main body of the brush, while the neck and head can be correspondingly reduced in thickness compared with the aforementioned known arrangements.

Additionally, operation of the actuating means serves the multipurpose of simultaneously feeding the paste to the head, opening the or each outlet and feeding the paste through the or each outlet to charge the bristles in a single action.

In a preferred embodiment of the invention a hollow neck portion extends between the container and the head, the head including a chamber therein in one sidewall of which is formed the or each outlet and in the opposed sidewall of which is mounted the or each control valve.

The head of the brush may comprise a cup-shaped end portion into which the neck portion feeds, the base of the end portion forming the opposed sidewall in which the or each control valve is mounted, and a closure portion including a base plate from which project the plurality of bristles, the base plate being a sealing fit in the end portion to define, together with the end portion, the chamber within the head, the base plate forming the one sidewall of the chamber containing the or each outlet.

Alternatively the head of the brush may comprise an end portion integral with the neck portion and having the chamber defined therein between one sidewall and an opposed sidewall of the end portion, the neck portion feeding into the chamber, the plurality of bristles projecting from the surface of the end portion containing the one sidewall, the or each outlet being formed in the one sidewall of the end portion and the or each control valve being mounted in the opposed sidewall of the end portion.

Conveniently an opening is formed through the opposed sidewall for the or each valve, the radially outer edge regions of the diaphragm portion of the valve being secured at or adjacent the bounding edge of the opening whereby the chamber within the head is sealed from the atmosphere.

In one embodiment of the invention the radially outer edge regions of the diaphragm portion of the control valve are molded or welded to the bounding edge of the opening in the opposed sidewall, whereby the control valve is permanently secured to the head.

In an alternative embodiment of the invention, the brush includes, for the or each control valve, a ring member which is a snap-fit in the opening to retain the radially outer edge regions of the diaphragm portion therein.

Preferably the nose portion of the control valve extends substantially the thickness of the one sidewall of the chamber such that, with the control valve in its normal rest position, the free end of the nose portion is located at or adjacent, and seals against, the end of the outlet remote from the chamber.

The control valve is conveniently integrally molded from a soft thermoplastic elastomer or a silicone rubber.

Although any suitable pump mechanism may be provided to feed the paste from the container to the head, a preferred brush is provided with actuating means including a manually-operated bellows the interior of which communicates into a reservoir positioned between the container and the head of the brush, the bellows having a normally expanded rest position, compression of the bellows feeding paste under pressure from the reservoir to the head, and subsequent release of the bellows causing the bellows to return to their rest position and to feed paste from the container to the reservoir.

Conveniently the actuating means comprise a one-way valve between the container and the reservoir which, on compression of the bellows, is closed whereby flow of paste between the container and the reservoir is prevented, and which, on expansion of the bellows, is opened whereby paste from the container is sucked into the reservoir through the one-way valve.

Preferably the bellows, the reservoir and the one-way valve comprise a single-piece moulding for location in the brush with the one-way valve at one end of the reservoir communicating with the container and with the other end of the reservoir communicating with the head of the brush.

DETAILED DESCRIPTION OF THE PREFERRED EMBODIMENTS

Figure 1:
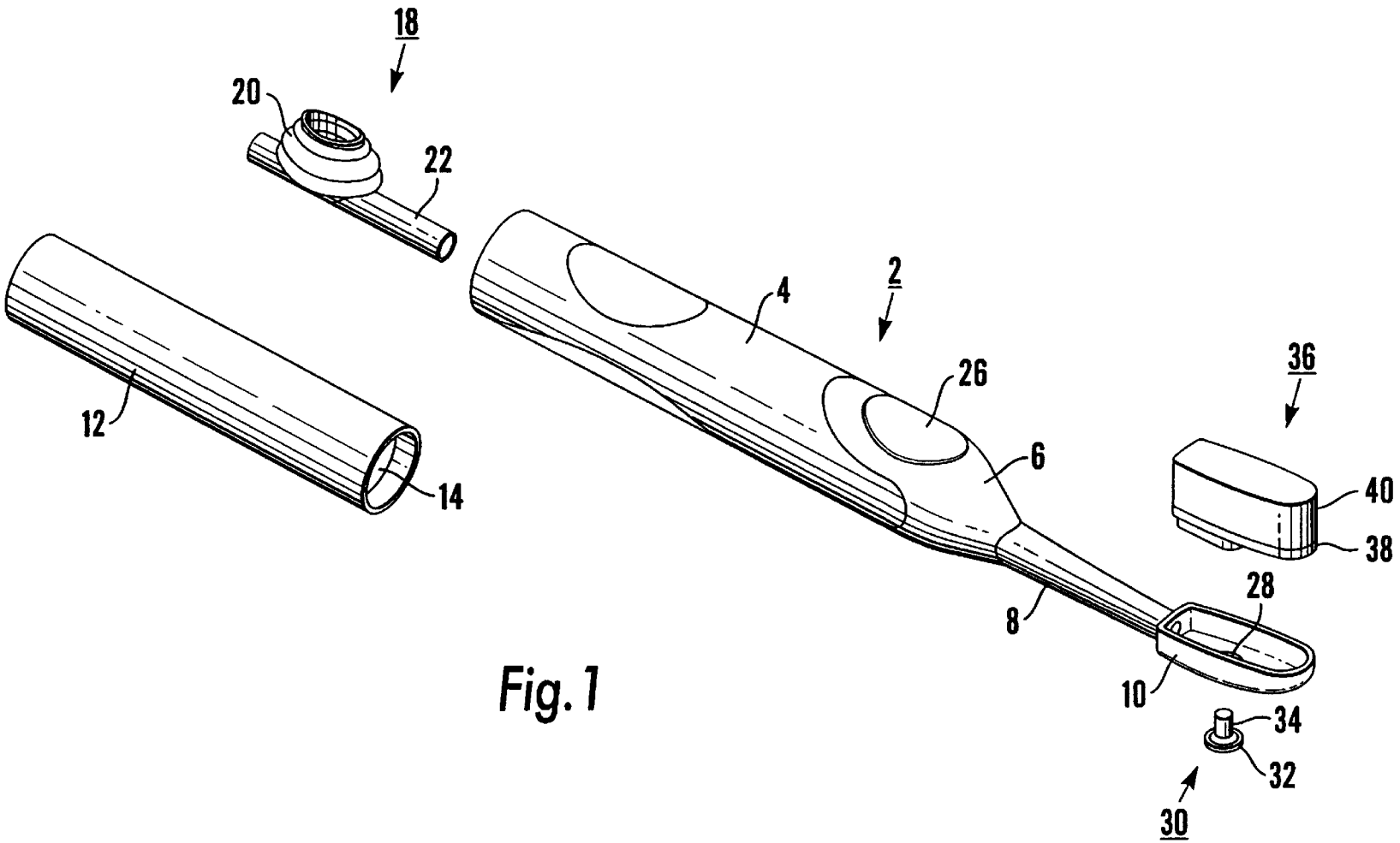
FIG. 1 is an exploded isometric view of a toothbrush according to the invention.
Figure 2:
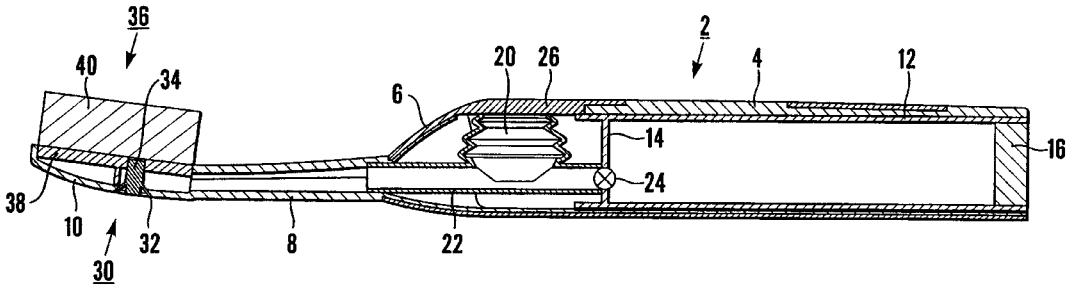
FIG. 2 is a longitudinal section through the toothbrush of FIG. 1.

Referring to FIGS. 1 and 2, the illustrated toothbrush comprises a hollow body member of a molded plastics material indicated generally at 2 and including an open-ended cylindrical portion 4, a tapering intermediate portion 6, a narrow neck portion 8 and an upwardly open, cup-shaped end portion 10 into which the neck portion feeds.

Located within the cylindrical portion 4 of the body member 2 is a cartridge 12 containing toothpaste, one end 14 of the cartridge 12 being sealed, and the other end of the cartridge 12 incorporating a piston 16 in conventional manner.

Actuating means for the toothbrush are indicated generally at 18 and comprise a flexible bellows 20, the interior of which feeds into an integrally molded reservoir in the form of a tube 22, the central axis of which is perpendicular to that of the bellows 20. One end of the tube 22 incorporates a one-way valve 24 and the other end of the tube 22 is open.

The actuating means 18 are located in the intermediate portion 6 of the body member 2 with the end of the tube 22 incorporating the one-way valve 24 extending through the one end of the cartridge 12 to interconnect the interior of said cartridge 12 with the interior of the tube 22 by way of said valve 24, and with the other end of the tube 22 feeding into the hollow neck portion 8 of the body member 2, and being sealed from the interior of the intermediate portion 6.

The intermediate portion 6 of the body member 2 incorporates a flexible, overmolded button 26 or thumb grip, the undersurface of which engages with the end of the bellows 20 remote from the tube 22 when said bellows 20 are in their normal expanded condition shown in FIGS. 1 and 2. Depression of the button 26 thus moves the bellows 20 into a compressed condition, subsequent release of the button 26 resulting in return of the button 26 and the bellows 22 to their normal positions as illustrated.

The base of the end portion 10 of the body member 2 has an aperture 28 formed therethrough in which is mounted a control valve indicated generally at 30.

More particularly, the valve 30, which is integrally molded from a soft thermoplastic elastomer or a silicone rubber, comprises a circular diaphragm portion 32 from one side of which projects a nose portion 34. The control valve 30 is secured in the aperture 28 in the base of the end portion 10 as best seen with reference to FIGS. 3*a* and 3*b* with the radially outer regions of the diaphragm portion 32 overmolded on the bounding edge of the aperture 28 and with the nose portion 34 projecting upwardly from the base of the end portion 10.

Figure 3A:
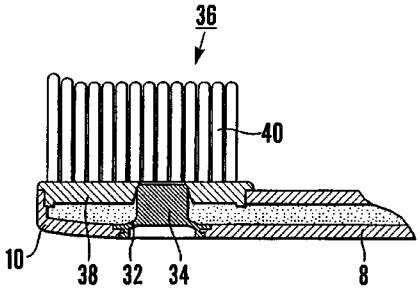
FIGS. 3*a* and 3*b* are vertical sections through the head of a toothbrush according to the invention with the control valve in its closed and open positions respectively.
Figure 3B:
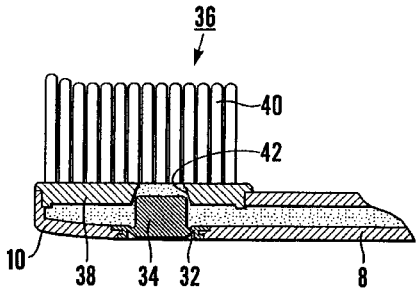

The brush is completed by a head indicated generally at 36 and including a base plate 38 upstanding from which are a plurality of bristles 40 and in which is formed a tapered outlet 42, again as best seen in FIGS. 3*a* and 3*b*.

The head 36 is a sealing snap-fit into the cup-shaped end portion 10 into an assembled operative position in which the outlet 42 is axially aligned with the control valve 30 and in which the nose portion 34 of the valve 30 seats in, to seal, the outlet 42 as shown in FIGS. 2 and 3*a*, the base plate 38 and end portion 10 together defining a sealed chamber in the end of the brush.

The described toothbrush operates as follows.

On compression of the bellows 20 by depression of the button 26, the volume within the brush between the one-way valve 24, which prevents flow from left to right as viewed in FIG. 2, and the outlet 42 through the base plate 38, which is closed by the nose portion 34 of the valve 30, is pressurised such that fluid therein, be it air or paste, is urged into forcible engagement with the one side of the diaphragm portion 32 to distort said diaphragm portion 32 whereby the nose portion 34 is displaced from the outlet 42 as seen in FIG. 3*b*, and the fluid can exit through the outlet 42.

On release of the button 26, the bellows 20 expand and return to their normal condition shown in FIG. 2, thus reducing the pressure in the aforementioned volume. As soon as the increased pressure is removed from the diaphragm portion 32 of the control valve 30, the valve 30 immediately returns, by virtue of its inherent resiliency, the effect of atmospheric pressure on the side of the diaphragm portion remote from the nose portion 34, and the slight draw-back pressure within said volume (see below), to its rest position with the nose portion 34 sealing the outlet 42.

The net result of the bellows 20 returning to its expanded condition is to create a suction effect in the volume between the now closed control valve 30 and the one-way valve 24, which serves to open the valve 24 whereby paste from the cartridge 12, which is under atmospheric pressure by way of the piston 16, is drawn into the tube 22. This charging of the tube 22 with paste is accompanied by movement of the piston 16 to the left as viewed in FIG. 2, return movement to the right being prevented by one-way means (not shown) in conventional manner.

Thus it will be appreciated that initial charging of the toothbrush with paste to fill the volume downstream of the valve 24 is achieved by sequential depression and release of the button 26.

Once this volume is filled, the toothbrush is ready for use.

The configuration of the brush is such that on depression of the button 26, a pre-determined quantity of paste is extruded through the outlet 42 and onto the bristles 40 sufficient for use by the user on release of the button 26, although additional paste, if required, can be obtained by further depressions of the button 26.

As can be seen in the drawings, and in particular in FIG. 3*a*, the nose portion 34 of the valve 30 in the rest position thereof extends substantially to the outer end of the outlet 42 and seals against said outer end in a knife edge manner whereby no previously extruded paste can remain in the outlet 42 after use of the toothbrush, no further paste can be extruded through the outlet 42, and the ingress of water and dirt through the outlet is prevented. Such an arrangement thus results in an extremely hygienic product and virtually eliminates the possibility of bacteria growing within the brush.

FIG. 1 illustrates that the toothbrush comprises a small number of individual parts all of which can be separately molded and robotically assembled.

The opening and closing of the outlet 42, as well as the feeding of paste to and through said outlet 42, are all achieved as a direct result of pressurisation of the paste, and without the requirement for any mechanical linkage between the actuating means 18 and the outlet 42. Thus there is no imposition upon the configuration of the hollow neck portion 8 which can be located at a variety of angles relative to the main extent of the body member 2 and can be flexible relative thereto, while the size of the head of the brush can be reduced compared with those containing sliders and the like.

Figure 4A:
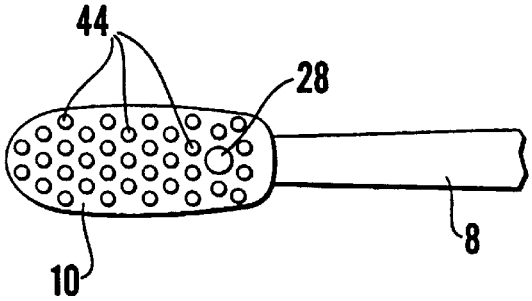
FIGS. 4*a* and 4*b* are a plan view and a longitudinal section respectively of the head of a further toothbrush according to the invention.
Figure 4B:
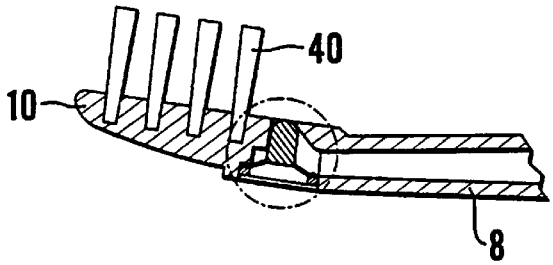
Figure 5:
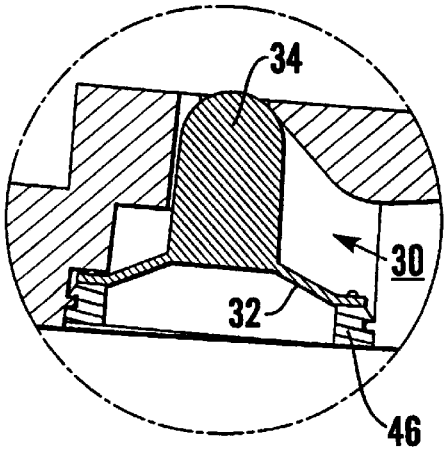
FIG. 5 is an enlarged detail of the encircled part of the head of FIG. 4*b*.

FIGS. 4*a*, 4*b* and 5 detail an alternative head in which the bristles 40 are located in a series of pre-formed holes 44 in the upper surface of the end extent 10 of the brush, rather than being part of a separate head for insertion into the end extent 10. The end extent 10 is bored to provide a chamber therein together with an outlet 42 and a seating for the control valve 30, the diaphragm portion 32 of the valve 30 being retained in the seating by means of a snap-fit ring 46. The diaphragm portion 32 may be overmolded on, or separate from, the ring 46, while the ring 46 may be welded in the seating instead of being a snap-fit therein. Alternatively the ring 46 may be dispensed with and the edge regions of the diaphragm portion 32 welded or otherwise secured to the seating.

Clearly the precise construction of the toothbrush may differ from those detailed above without departing from the scope of the invention. The actuation means may be other than bellows operated, and may comprise relatively conventional trigger-operated pumps. It must be appreciated, however, that the described actuating means has the advantage that, in the event that the control valve 30 is inadvertently displaced from the outlet 42 subsequent to use, it will not be possible to recharge the bristles 40 with paste because of the open nature of the volume between the outlet 42 and the valve 24 and the inability to create the necessary suction effect within that volume. Such an arrangement thus prevents the extrusion of excessive amounts of paste that might otherwise occur in the event of failure of the valve 30.

There may be a plurality of outlets 42 feeding to the bristles and a corresponding plurality of valves 30, which may or may not be interconnected with one another.

The diaphragm portions 32 of the valves 30 of FIGS. 1, 2, 3*a* and 3*b* may be secured in position other than by overmolding, for example by ultrasonic welding or by being a pop-in friction fit in the associated opening 28.

Other modifications and variations will be apparent to those skilled in the art.

The described toothbrushes are inherently user friendly in view of their compact and ergonomic design and their simple operation, while the pre-determined quantity of paste supplied to the bristles by the simple pneumatic actuating system can readily be varied to suit particular requirements. The product is ideally suited to the mass market because of its convenience for day to day use, but is also appropriate for specialised niche markets such as travellers, sportsmen and other related users.

Although described in relation to toothbrushes, it will be appreciated that the basic inventive concept has application to other types of brushes provided with containers for paste or other dispensable materials.

What is claimed is:

1. A brush comprising a head including a plurality of bristles thereon, at least one outlet in the head feeding to said bristles, a container of paste connected to said head, and actuating means for feeding paste from the container longitudinally of the brush to the head, at least one control valve associated with a respective one of said at least one outlet comprising a flexible plastics material including a diaphragm portion and a nose portion extending from one side of the diaphragm portion, the control valve being positioned within the head with a central axis thereof substantially perpendicular to the direction of flow of paste to the head and having a normal rest position in which the nose portion engages in, to seal, the respective outlet in the head, the other side of the diaphragm portion of the control valve remote from the nose portion being open to the atmosphere, the arrangement being such that, on operation of the actuating means, paste is fed under pressure from the container to the head to engage with the one side of the diaphragm portion to distort said diaphragm portion, whereby the nose portion of the valve is displaced from the outlet and paste is dispensed therethrough, and, on subsequent depressurisation of the paste, the control valve returns, under the influence of its inherent flexibility and atmospheric pressure, to its rest position with the nose portion seating in, to seal, the respective outlet.

2. A brush is claimed in claim 1 wherein a hollow neck portion extends between the container and the head, the head including a chamber therein defined between one sidewall in which is formed the at least one outlet and an opposite sidewall in which is mounted the at least one control valve.

3. A brush as claimed in claim 2 wherein the head comprises a cup-shaped end portion into which the neck portion feeds, a base of the end portion forming the opposed sidewall in which the at least one control valve is mounted, and a closure portion including a base plate from which project the plurality of bristles, the base plate forming a sealing fit in the end portion to define, together with the end portion, the chamber within the head, the base plate forming the one sidewall of the chamber containing the at least one outlet.

4. A brush as claimed in claim 2 wherein the head comprises an end portion integral with the neck portion and having the chamber defined therein between one sidewall and an opposed sidewall of the end portion, the neck portion feeding into the chamber, the plurality of bristles projecting from the surface of the end portion containing the one sidewall, the at least one outlet being formed in the one sidewall of the end portion and the at least one control valve being mounted in the opposed sidewall of the end portion.

5. A brush as claimed in claim 2 wherein at least one opening is formed through said opposed sidewall for the control valve, radially outer edge regions of the diaphragm portion of the control valve being sealingly secured at or adjacent a bounding edge of the at least one opening.

6. A brush as claimed in claim 5 wherein the radially outer edge regions of the diaphragm portion of the at least one control valve are molded or welded to the bounding edge of the opening in the opposed sidewall, whereby the at least one control valve is permanently secured to the head.

7. A brush as claimed in claim 5 and including, for the at least one control valve, a ring member which is snap-fit in the opening to retain the radially outer edge regions of the diaphragm portion therein.

8. A brush as claimed in claim 2 in which the nose portion of the control valve extends substantially the width of the one sidewall of the chamber such that, with the control valve in its normal rest position, a free end of the nose portion is located at or adjacent, and seals against, an end of the outlet remote from the chamber.

9. A brush as claimed in claim 1 in which the control valve is integrally molded from a soft thermoplastic elastomer or a silicone rubber.

10. A brush as claimed in claim 1 in which the actuating means include a manually-operated bellows, the interior of which communicates into a reservoir positioned between the container and the head of the brush, the bellows having a normally expanded rest position, compression of the bellows feeding paste under pressure from the reservoir to the head, and subsequent release of the bellows causing the bellows to return to their rest position and to feed paste from the container to the reservoir.

11. A brush as claimed in claim 10 in which the actuating means comprise a one-way valve between the container and the reservoir which, on compression of the bellows, is closed, whereby flow of paste between the container and the reservoir is prevented, and which, on expansion of the bellows is opened, whereby paste from the container is sucked into the reservoir through the one-way valve.

12. A brush as claimed in claim 11 in which the bellows, the reservoir and the one-way valve comprise a single-piece molding for location in the brush with the one-way valve at one end of the reservoir communicating with the container and with the other end of the reservoir communicating with the head of the brush.

* * * * *